US010718171B2

(12) United States Patent
McCorriston et al.

(10) Patent No.: US 10,718,171 B2
(45) Date of Patent: Jul. 21, 2020

(54) MODIFIED DIE BLOCK FOR DRILLING RIG FLOOR WRENCH

(71) Applicant: DRILLFORM TECHNICAL SERVICES LTD., Calgary (CA)

(72) Inventors: Todd McCorriston, Calgary (CA); Patrick McDougall, Calgary (CA); Vladimir Scekic, New Westminster (CA)

(73) Assignee: DRILLFORM TECHNICAL SERVICES LTD., Alberta (CA)

( * ) Notice: Subject to any disclaimer, the term of this patent is extended or adjusted under 35 U.S.C. 154(b) by 104 days.

(21) Appl. No.: 15/574,018

(22) PCT Filed: May 11, 2016

(86) PCT No.: PCT/CA2016/050540

§ 371 (c)(1),
(2) Date: Nov. 14, 2017

(87) PCT Pub. No.: WO2016/183670

PCT Pub. Date: Nov. 24, 2016

(65) Prior Publication Data

US 2018/0298704 A1 Oct. 18, 2018

Related U.S. Application Data

(60) Provisional application No. 62/162,059, filed on May 15, 2015.

(51) Int. Cl.
*E21B 19/16* (2006.01)

(52) U.S. Cl.
CPC ..... *E21B 19/161* (2013.01)

(58) Field of Classification Search
CPC ..... E21B 19/161
USPC ..... 81/57.34, 423, 177.85
See application file for complete search history.

(56) References Cited

U.S. PATENT DOCUMENTS 448,451 A * 3/1891 Miller ..... B25B 7/04 81/423
1,543,175 A * 6/1925 McCarthy ..... B25B 23/065 81/121.1
3,023,651 A 3/1962 Wallace
3,176,551 A * 4/1965 Hansen ..... B25B 7/04 81/423

(Continued)

FOREIGN PATENT DOCUMENTS

CA 2477186 A1 2/2005
CA 2773295 A1 10/2013

OTHER PUBLICATIONS

International Search Report & Written Opinion for PCT/CA2016/050540; 7 pages.

(Continued)

*Primary Examiner* — Hadi Shakeri
(74) *Attorney, Agent, or Firm* — Sheridan Ross PC

(57) ABSTRACT

Modified tong assemblies for drilling rig floor wrenches are provided, each tong assembly providing die blocks having "quick-release" gripping die for gripping and manipulating wellbore tubulars. According to embodiments herein, each tong assembly includes die blocks forming at least two opposed slots for receiving the die within the slots, and having at least one spring-actuated retainer pin for releasably securing the die within the slots.

17 Claims, 9 Drawing Sheets

(56) References Cited

U.S. PATENT DOCUMENTS

| | | | | |
|---|---|---|---|---|
| 3,261,241 | A * | 7/1966 | Catland | E21B 19/164 81/57.18 |
| 4,250,773 | A * | 2/1981 | Haynes | E21B 19/164 81/57.18 |
| 4,649,777 | A | 3/1987 | Buck | |
| 4,890,520 | A * | 1/1990 | Vassiliou | B25B 7/00 81/365 |
| 5,653,297 | A * | 8/1997 | Whisenhunt | E21B 19/163 173/164 |
| 6,474,202 | B2 * | 11/2002 | Frazer | B25F 1/003 81/168 |
| 7,975,572 | B2 * | 7/2011 | Nelson | E21B 19/164 81/57.18 |
| 8,366,592 | B2 * | 2/2013 | Hathaway | B23B 31/1071 279/2.12 |
| 2002/0108748 | A1 | 8/2002 | Keyes | |
| 2006/0027047 | A1 | 2/2006 | Buck | |
| 2016/0102509 | A1 | 4/2016 | Scekic et al. | |

OTHER PUBLICATIONS

Extended European Search Report dated Nov. 26, 2008 for application No. 16795584.8.

* cited by examiner

MODIFIED DIE BLOCK FOR DRILLING RIG FLOOR WRENCH

CROSS-REFERENCE TO RELATED APPLICATIONS

This application claims priority to PCT Application No. PCT/CA2016/050540, having a filing date of May 11, 2016, based off of U.S. Provisional Application No. 62/162,059 filed May 15, 2015, the entire contents both of which are hereby incorporated by reference.

FIELD OF TECHNOLOGY

The following relates the tong assemblies of automated drill pipe wrenches on the floor of a drilling rig, where the wrench is used to handle wellbore tubulars. More specifically, improved tong assemblies are provided, the tong assemblies having modified die blocks capable of "quick-releasing" gripping dies.

BACKGROUND

Many automated drill pipe wrenches used to make up or break down wellbore tubulars on drilling rigs are known. Some wrenches comprise two or three rams in opposed relation, each ram having a pair of tong dies or "gripping teeth" to contact, hold and manipulate the tubulars. Unfortunately, the force required to grasp the tubular can score or damage the tubular surface, resulting in premature wearing of the tubular. Further, the die used to contact and grip the tubular become dull (wear down), break, or become displaced over time.

International Patent Application No. PCT/CA2014/000401 describes a drilling rig floor wrench (the '401 Application). The wrench disclosed in the '401 Application comprises a plurality of die blocks that comprise, inter alia, die holders for releasably receiving and securing gripping dies. The dies can be secured in die slots on the front face of the die blocks using threaded screws or nut and bolt assemblies. To replace the dies, a laborer must unthread the screws, or loosen the nuts, such that the bolts are completely withdrawn from the block. Problems arise where the screws or nuts are too tight to be removed manually, the hardware become stripped and cannot be reused, or loose parts become lost due to dropping. Furthermore, replacement of each individual die in this manner can be time consuming.

There is a need for a fast, efficient and easy way to "quick release" (e.g. insert/remove) dies positioned within die blocks on the tong assemblies of automated drill pipe wrenches on the floor of a drilling rig.

SUMMARY

An aspect relates to modified tong assemblies for drilling rig floor wrenches used for handling wellbore tubulars. The tong assemblies, used to makeup and break apart wellbore tubulars, comprise modified die blocks capable of quick-releasing at least one die mounted thereon, the die being used to grip and apply torque to the tubulars.

In some embodiments, the present tong assemblies comprise a plurality of die blocks for receiving a die to grip the tubular, each die block forming at least two opposed slots for receiving the die within the slots, and having at least one retainer pin for releasably securing the die within the slots. In some embodiments, the at least one retainer pin may comprise a spring-actuated retainer pin. The at least one retainer pin may form a shoulder capable of abutting the die, securing the die within the slots. In combination, the die slots and pin shoulders may enable secure mounting of the die to the die block along the sides and upper/lower ends of the die.

In some embodiments, the present tong assemblies comprise at least one spring-actuated pin having a coil spring encircling the pin shaft and capable of exerting an outward force on the pin. In some embodiments, compression of the spring-actuated pin releases the die from the die slots.

In some embodiments, the present tong assemblies comprise modified die blocks forming at least one pin hole for receiving the at least one retainer pins. Pin holes may comprise at least two sections having different internal diameters from one another. In some embodiments, pin holes may comprise at least three sections having different diameters from one another.

In some embodiments, the present tong assemblies comprise at least one dowel for securing the at least one retainer pin within the die block. The present modified die blocks may form at least one dowel hole for receiving the at least one dowel. The at least one retainer pin may form at least one dowel slot for receiving the dowel therein, securing the pin within the pin hole.

BRIEF DESCRIPTION

Some of the embodiments will be described in detail, with references to the following figures, wherein like designations denote like members, wherein.

DETAILED DESCRIPTION

Modified tong assemblies for automated drill pipe floor wrenches used on drilling rig are provided. The tong assemblies, used to makeup and break apart wellbore tubulars, comprise modified die blocks capable of quick-releasing at least one die mounted thereon, the die being used to grip and apply torque to the tubulars.

Figure 1:
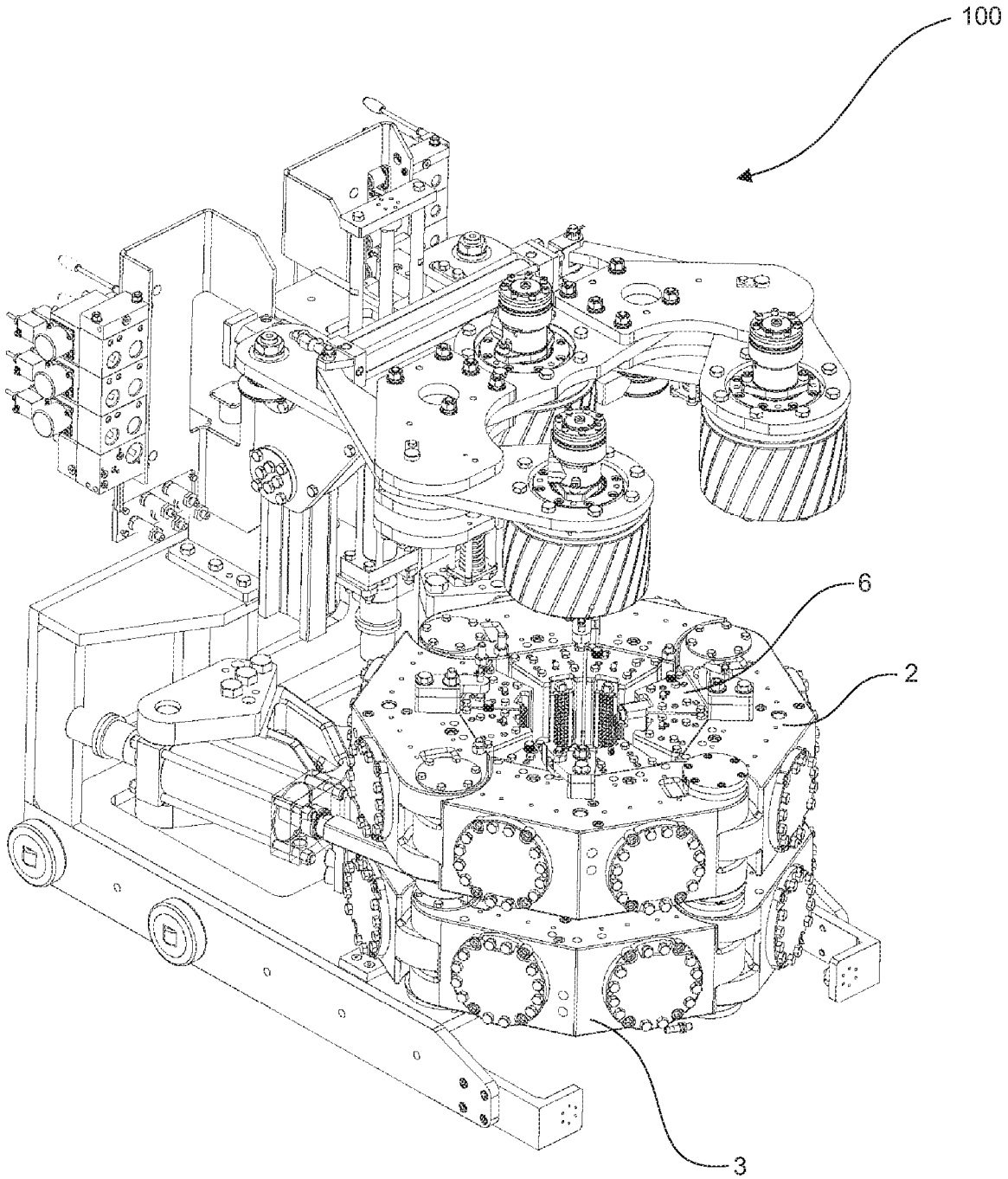
Fig. 1 PRIOR ART
FIG. 1 (PRIOR ART) is a perspective view of an automated drill pipe wrench according to embodiments herein.
Figure 2:
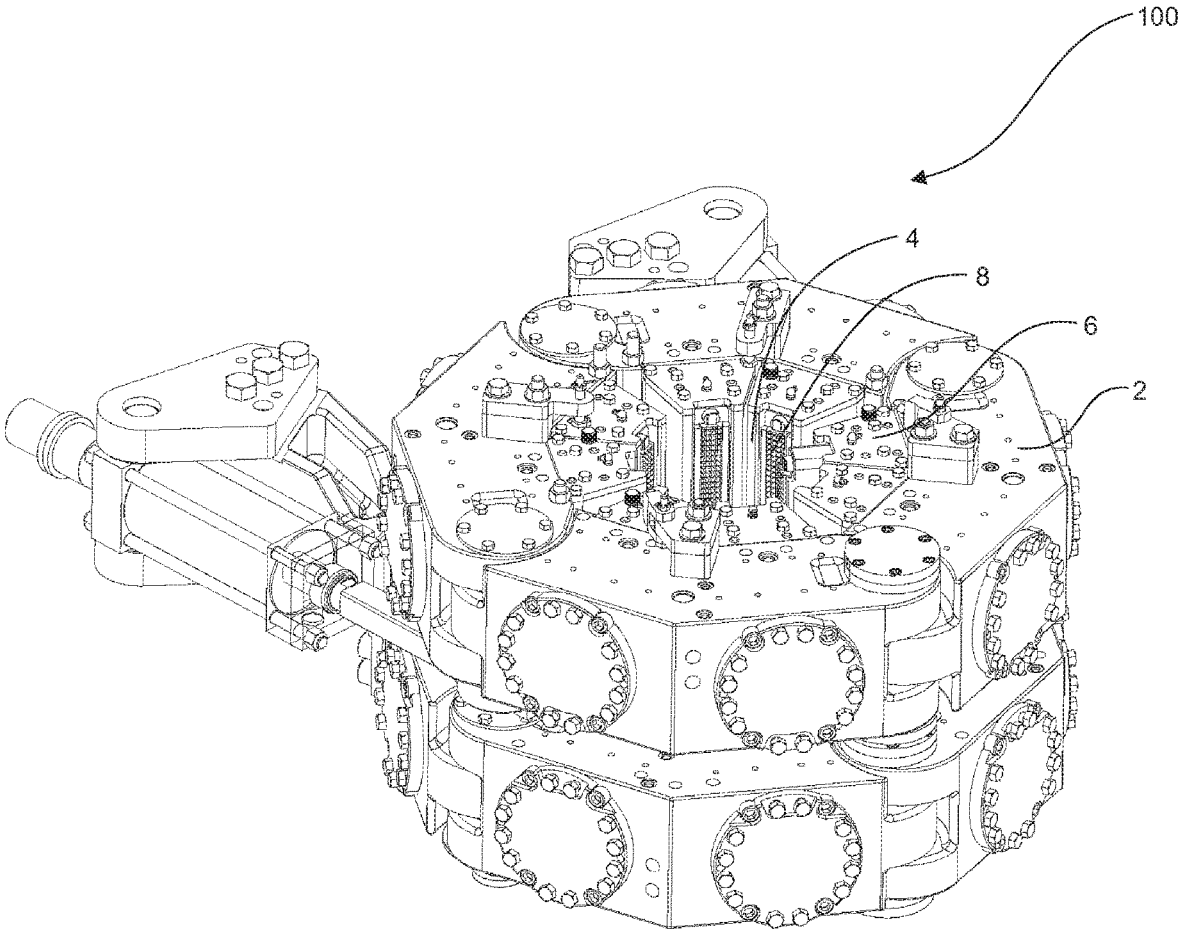
Fig. 2 PRIOR ART
FIG. 2 (PRIOR ART) is a further perspective view of the upper and lower tong assemblies of the wrench in FIG. 1.

Having regard to FIGS. 1 and 2 (PRIOR ART), automated drill pipe torque wrenches 100 used on drill rig floors can comprise hydraulically-powered upper and lower tong assemblies 2, 3. Each upper and lower tong assembly 2, 3 can comprise a plurality of die blocks 6 for supporting at least one gripping die 8. More specifically, the plurality of die blocks 6 of each assembly 2, 3 can form central recess 4, for receiving wellbore tubulars including, for example, joints of drill pipe, drill collars, casing, liners etc. (not shown). When a tubular is positioned within the recess 4, such that the tubular generally extends axially through the recess 4 and is positioned above the wellbore, each die block 6 acts substantially diametrically opposite one another to engage and manipulate the tubular.

Figure 3:
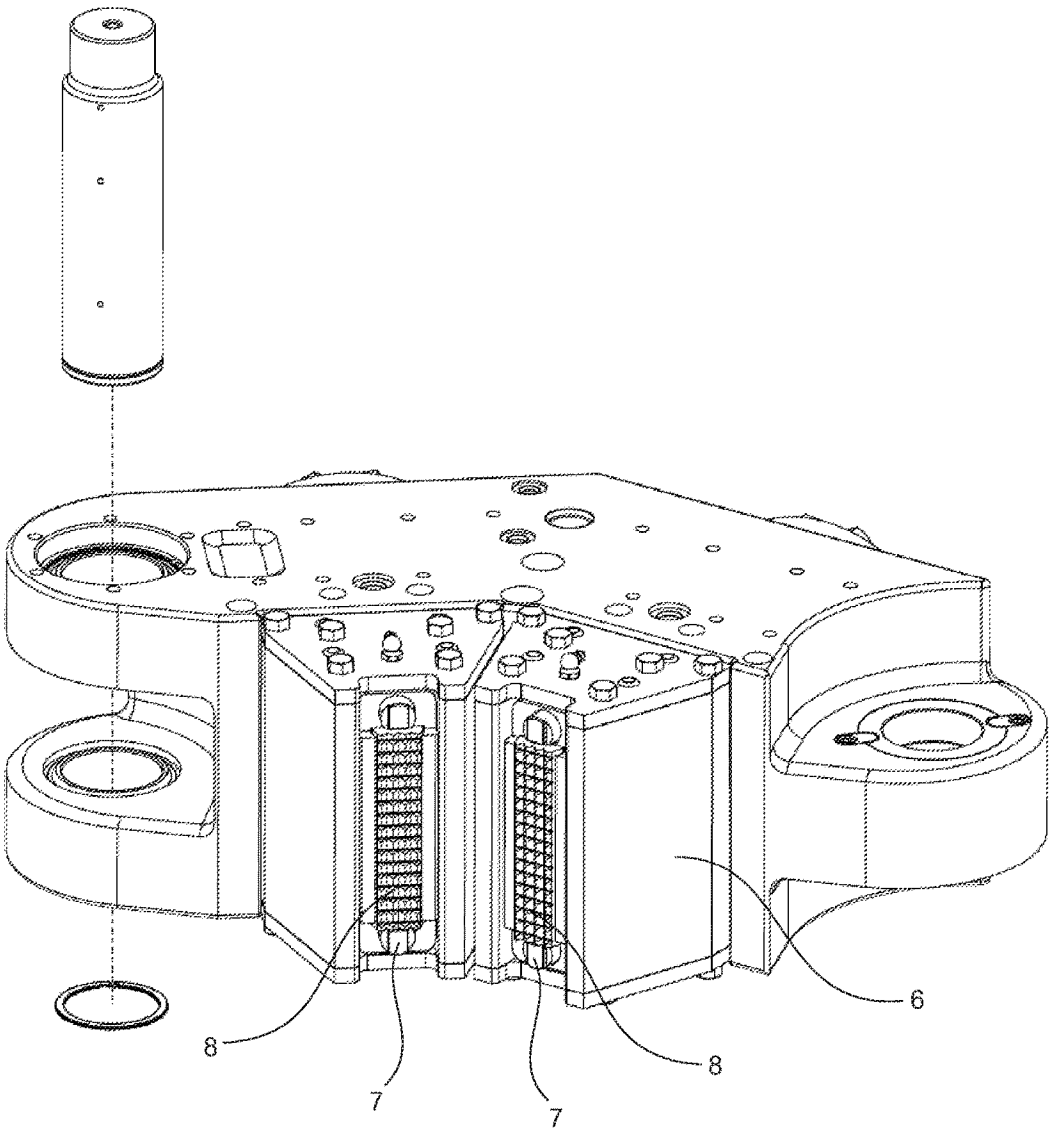
Fig. 3 PRIOR ART
FIG. 3 (PRIOR ART) is a zoomed in perspective view of two die blocks positioned on a tong assembly of the wrench shown in FIG. 1.
Figure 4:
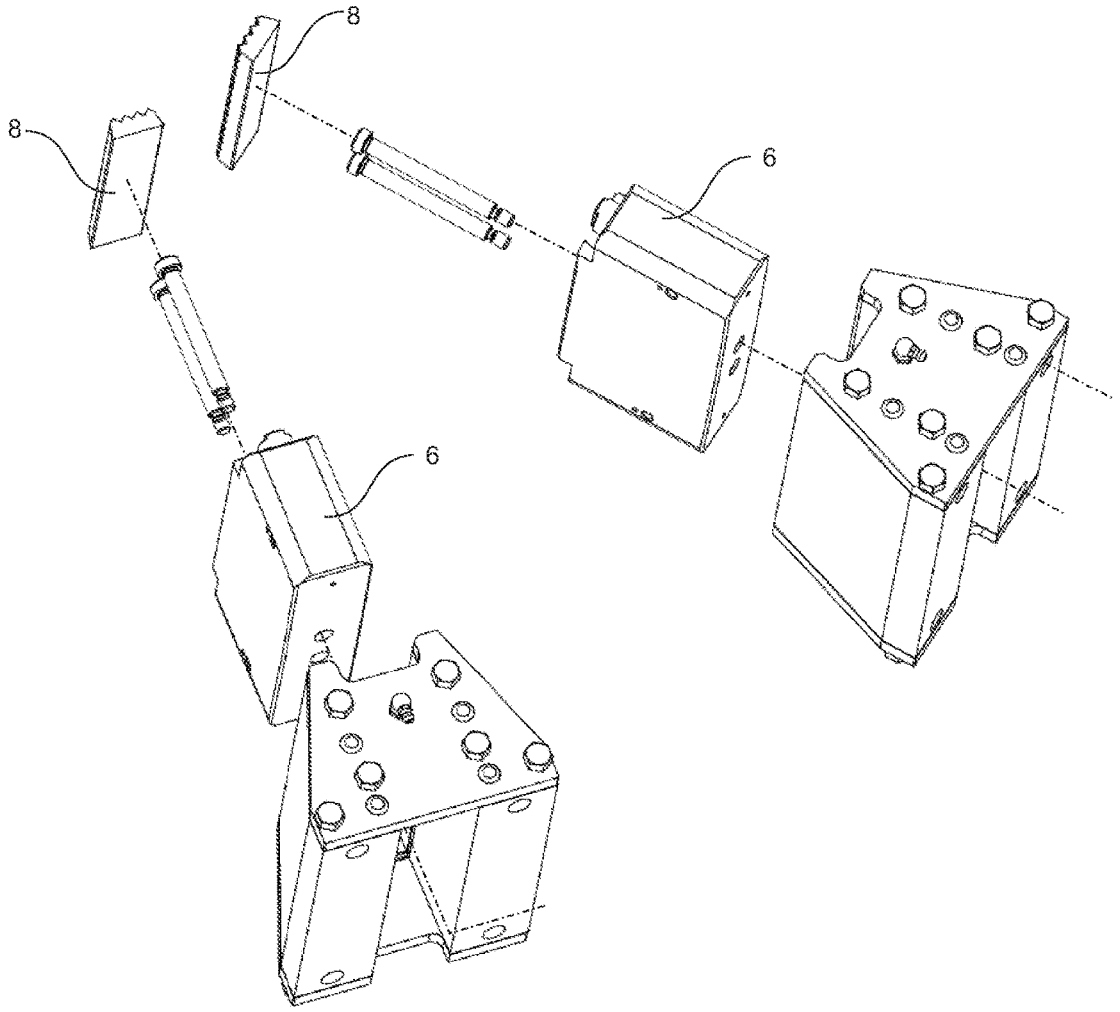
Fig. 4 PRIOR ART
FIG. 4 (PRIOR ART) is an exploded view of the die blocks shown in FIG. 3.

Having regard to FIGS. 3 and 4 (PRIOR ART), each gripping die 8 can be securely affixed to a corresponding die block 6 via nuts and bolts 7, or via threaded screws (not shown). As such, laborers wanting to remove a gripping die 8 to repair or replace the die 8, the laborer must loosen each nut or unthread each screw, completely removing the individual pieces hardware until the die 8 can be withdrawn from the block 6. Such a process is extremely time-consuming and difficult, particularly where the nuts or screws are too tight to be removed manually, the nuts or screws become stripped or the nuts or screws become lost due to dropping of the loose parts.

According to embodiments herein, the present modified tong assemblies (see upper tong 12 shown in FIG. 9), having a plurality of modified die blocks 10, will now be described having regard to FIGS. 5-9.

Figure 5:
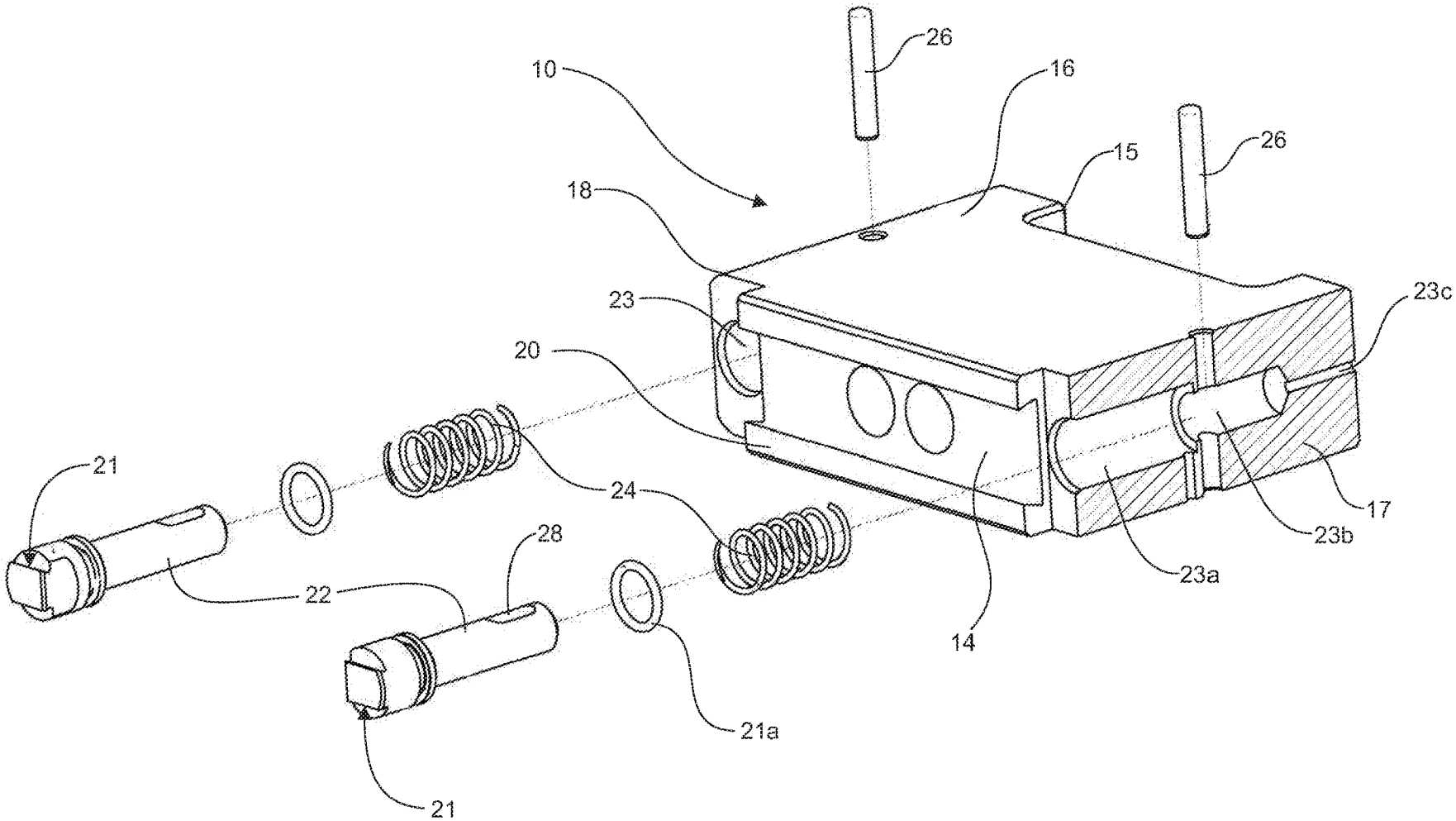
FIG. 5 is an exploded view of the modified die blocks according to embodiments herein.
Figure 6:
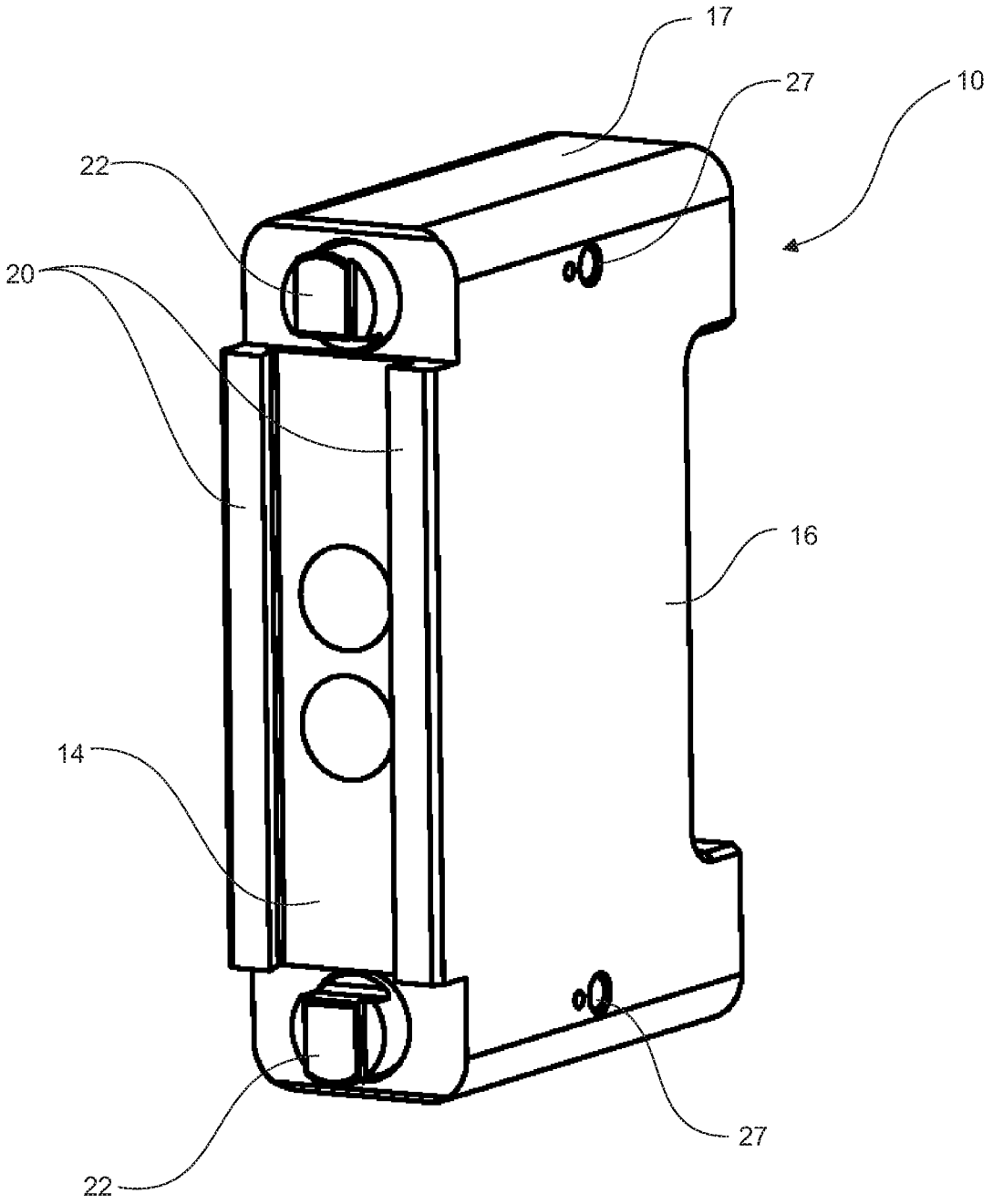
FIG. 6 is a perspective view of the modified die block of FIG. 5 (die not shown)

Having regard to FIGS. 5 and 6, each of the present upper and lower tong assemblies may comprise modified die blocks 10 adapted to releasably receive a die 19 (see FIG. 9) for gripping wellbore tubulars positioned within the wrench 100. It would be understood that each die 19 is configured to provide at least one surface of gripping teeth for engaging the surface of the tubular.

As would be known, die blocks 10 mounted upon upper and lower tong assemblies to form recess 4 are hydraulically actuated towards and away from wellbore tubulars (i.e. into and out of gripping position). Each die block 10, may comprise front, rear, and side surfaces 14, 15, 16, and top and bottom surfaces 17, 18. Front surface 14 may be configured to provide opposed slots 20 extending substantially longitudinally from top 17 to bottom 18 surface, for slidably receiving die 19 therebetween. For example, slots 20 may protrude outwardly from and extend axially across front surface 14. Die slots 20 may be sized and shaped in any manner so as to correspond with and to guide the die 19 to be received and secured therebetween. Die slots 20 may be manufactured from any known suitable material and affixed to the front surface 14 of die block 10 in any manner known in the art, or die slots 20 may be manufactured to be integral to die block 10.

According to embodiments herein, the present tong assemblies may provide means for "quick releasing" the die 19 from the die block 10, eliminating the need for cumbersome nut and bolt or threaded screw hardware. For example, modified die blocks 10 may comprise spring-biasing means for releasably retaining each die 19 within the die blocks 10. In one embodiment, the spring-biasing means may comprise at least one spring-actuated cylindrical retainer pin 22 for engaging the die 19 and securing it in position within the die slots 20. In a preferred embodiment, the present die blocks 10 may comprise two diametrically opposed pins 22 for securing the die 19 along its upper and lower (top and bottom) ends. It should be understood that pins 22 may be manufactured from any suitable material and appropriately sized for use with automated drill pipe torque wrenches 100. Pins 22 may be appropriately sized for use with a drilling rig wrench 100 and, for example, may have a shaft diameter of approximately 0.5 inches, and a pin head diameter of approximately 0.8 inches.

Figure 7:
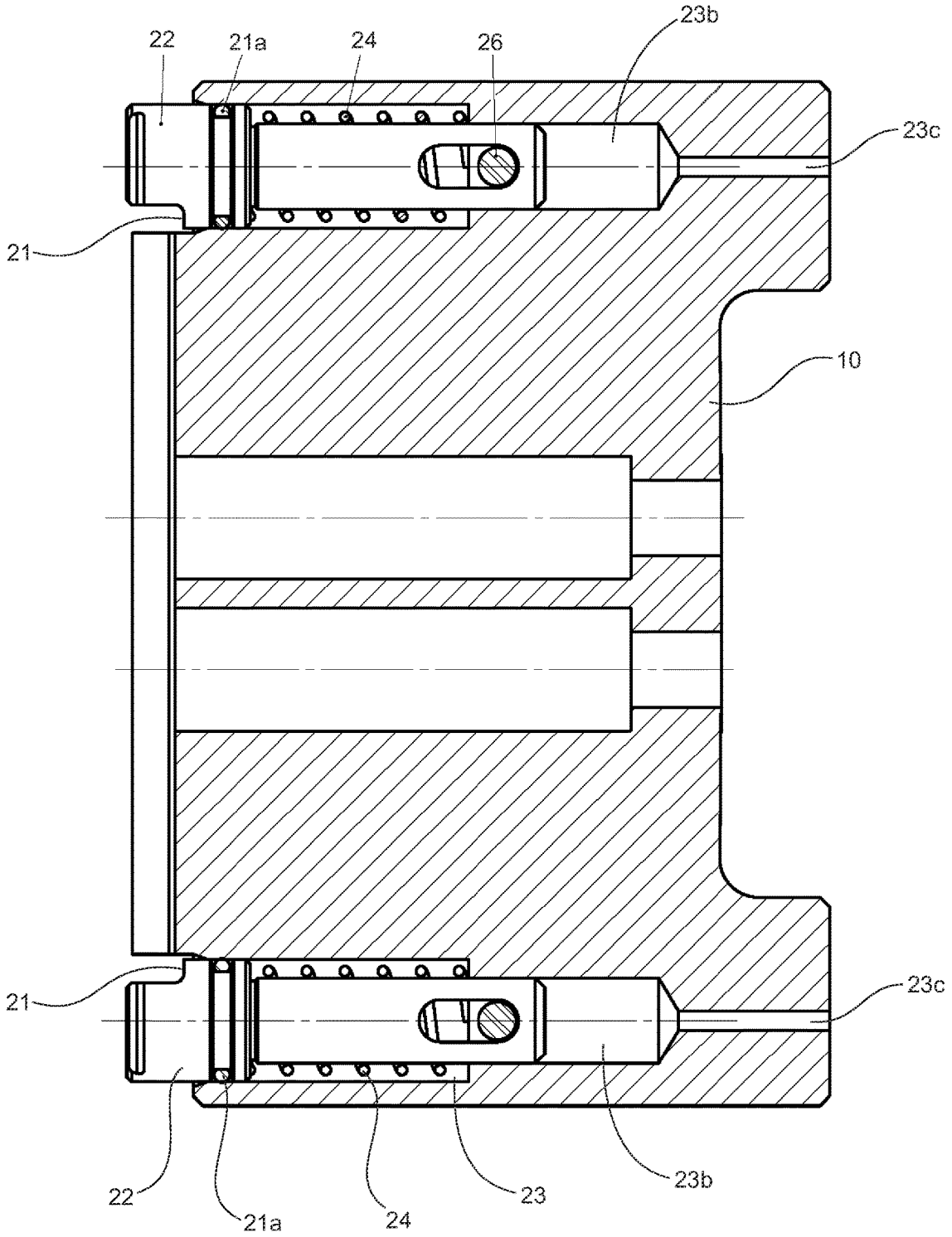
FIG. 7 is a top cross-sectional view of the modified die block of FIG. 6 (die not shown)
Figure 8:
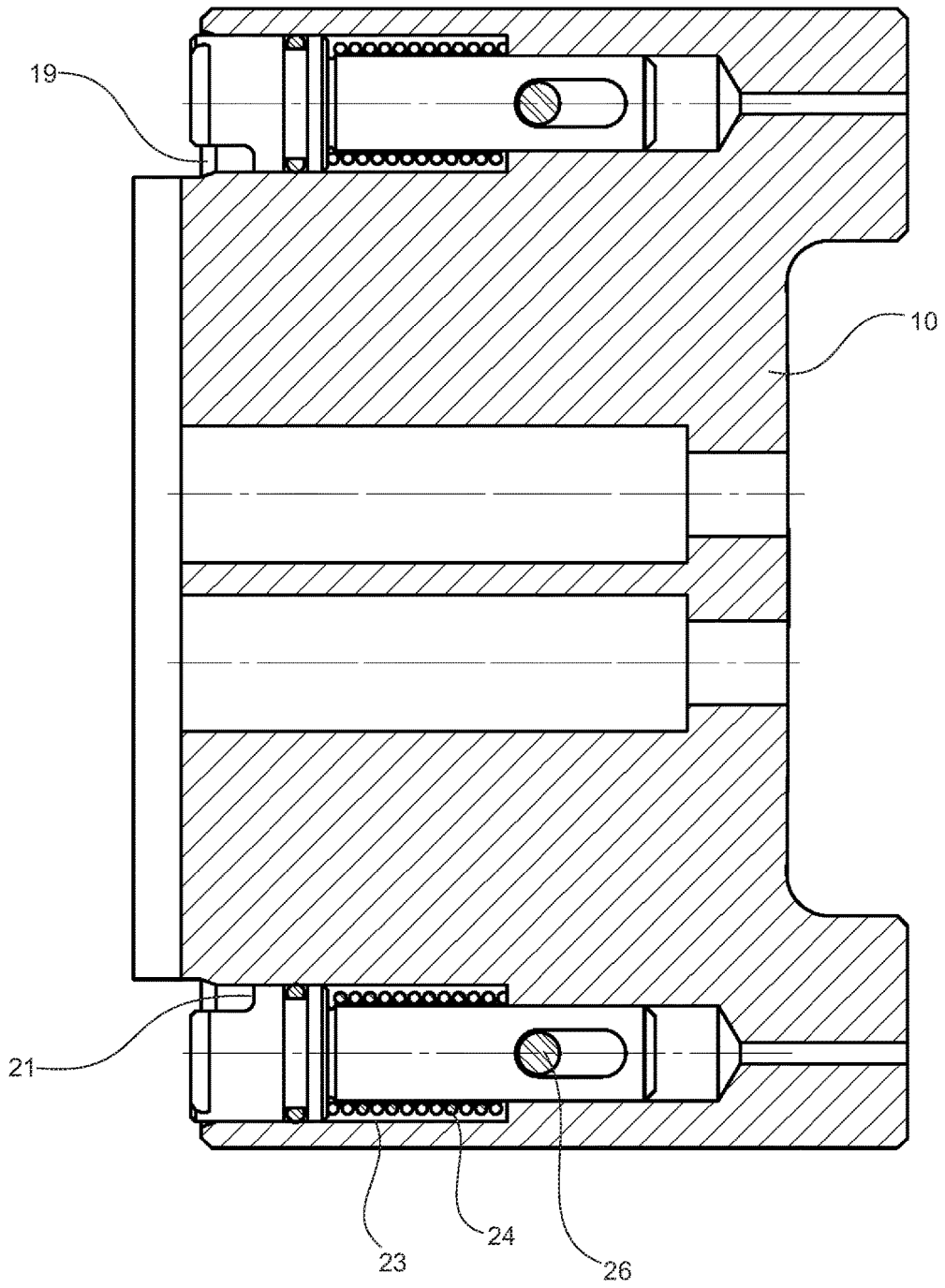
FIG. 8 is the top cross-section view of the modified die block in FIG. 7 (die in place, and retainer pins biased inwardly)

According to embodiments herein, having regard to FIGS. 7 and 8, pins 22 may, at or near the pinhead, form a shoulder 21 for abutting die 19 at its top and bottom ends, preventing the die 19 from moving upwards or downwards within the slots 20. In other words, in combination, slots 20 and pins 22 retain die 19 within the die block 10 at its upper and lower ends, and along its sides, respectively (such that the die 19 is securely retained within the die block 10 along all four sides of the die 19).

The present spring-biasing means may further comprise coil springs 24 for exerting outward force on the pins 22, causing pins 22 and shoulders 21 to abut the die 19, retaining the die 19 in position. In operation, in order to insert or remove the die 19, one or both retainer pins 22 may be pushed inwardly, compressing the spring 24 against the force exerted outwardly, until the die 19 can be slidably inserted or removed from the slots 20 (see FIG. 9). Spring 24 may be sized and configured to exert an appropriate amount of outward force and, for example, may exert a travel deflection of approximately 1.4 inches, with a spring rate of approximately 13.7 lbf. Pin 22 may be sealed within die block 10 by any known sealing means, such as by a common o-ring seal 21*a* (e.g. OD 0.72", LG 2.5").

In some embodiments, having regard to FIGS. 6 and 7, the present die block 10 may be adapted to provide two spring-actuated retainer pins 22. In one embodiment, the front surface 14 of the die block 10 may comprise at least one retainer pin bore or hole 23 for receiving one retainer pin 22. Hole 23 may extend rearwardly towards rear surface 15, and may or may not extend entirely through die block 10. Hole 23 may be form a generally cylindrical cross section, and form one or more sections, each section having different internal diameters from one another.

More specifically, hole 23 may comprise at least two sections 23*a*, 23*b*, wherein a first section 23*a* may be sized to receive both pin 22 and coil spring 24 encircling the pin 22 shaft, and a second section 23*b* may be sized to receive pin 22 shaft alone. More specifically, first section 23*a* may have an internal diameter equal or greater than the external diameter of pin 22 shaft encircled by spring 24 (e.g. approximate diameter of greater than 0.5 inches, but less than 0.8 inches), while section 23*b* may have an internal diameter equal to or greater than pin 22 shaft alone (e.g. approximate diameter of greater than 0.5 inches). In some embodiments, hole 23 may further comprise a third section 23*c* for providing air ventilation through hole 23, preventing suctioning of the pin 22 within pin hole 23. The internal diameter of third section 23*c* may be smaller than or equal to the external diameter of pin 22.

Having further regard to FIGS. 7 and 8, the present tong assemblies may further comprise dowels 26 to prevent retainer pins 22 from inadvertently falling out of holes 23. For example, when die 19 is not in place within slots 20, dowel 26 may serve to prevent pin 22 from dislodging from holes 23. More specifically, in one embodiment, one or more dowel holes 27 may be formed in side surface 16 of the present die block 10, each dowel hole 27 extending entirely through die block 10. It should be understood that dowels 26 may be manufactured from any suitable material and appropriately sized for use with automated drill pipe torque wrenches 100 (e.g. approximately 1.5" in length).

According to embodiments herein, pins 22 may be configured to form dowel slots 28 therethrough for receiving dowel 26. Accordingly, when pin 22 is positioned within hole 23, dowel holes and pin slots 27, 28 align to receive dowel 26, the dowel 26 serving to retain pins 22 within hole 23 by counteracting the outward forces exerted by spring 24.

Without dowel 26, when die 19 is not in position to abut shoulder 21, spring 24 may bias pin 22 out of hole 23). Slots 28 in pins 22 may be sized and shaped to allow longitudinal movement of pin 22 within hole 23 during compression of spring 24 (i.e. when pin 22 is pushed in by laborer, dowel 26 can slide from end-to-end within slot 28).

Figure 9:
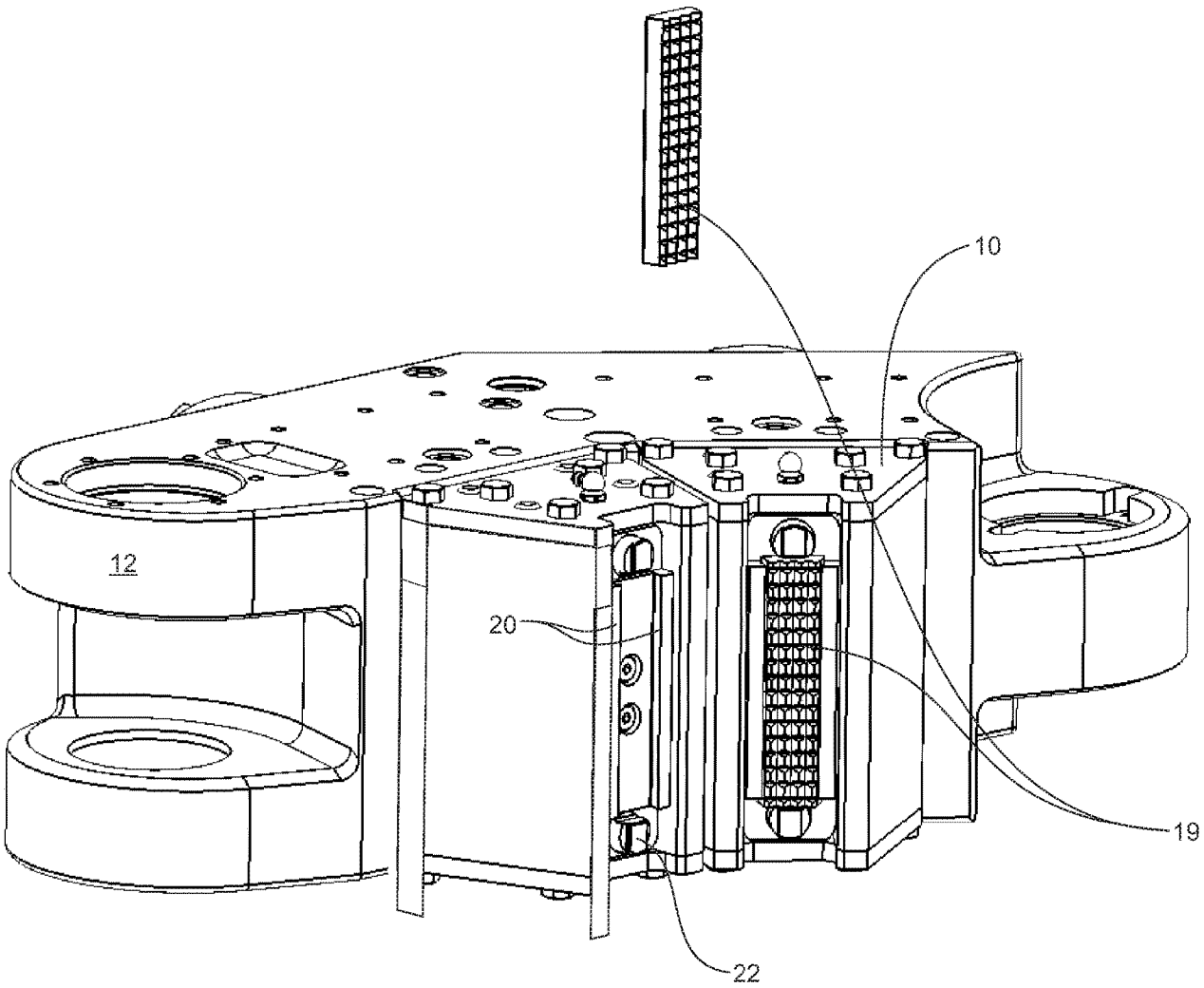
FIG. 9 is a perspective view of the modified die block according to embodiments herein, one retainer pin shown in position within die slot and one retainer pin shown above die slot with upper retainer pin biased inwardly.

In operation, having regard to FIG. 9, die blocks 10 may be secured to an automated drilling rig floor wrench 100 in any manner known in the art, such that die blocks 10 are positioned diametrically opposite one another and actuated into and out of engagement with the wellbore tubular. Once in place, a laborer desiring to insert or remove a die 19 from die blocks 10 may "quick-release" the spring-actuated the at least one retainer pin 22 by pushing said pin(s) 22, compressing spring 24, allowing die 12 to be slidably released up or down in/out of slots 20. When die 19 is in position in slots 20, shoulder 21 pin(s) 22 secures die 19 in place. When die 19 is not in position in the slots 20, dowel 26 prevents pin(s) 22 from dislodging die block 10.

Although the present invention has been disclosed in the form of preferred embodiments and variations thereon, it will be understood that numerous additional modifications and variations could be made thereto without departing from the scope of the invention.

For the sake of clarity, it is to be understood that the use of "a" or "an" throughout this application does not exclude a plurality, and "comprising" does not exclude other steps or elements.

We claim:

1. An automated drilling rig floor wrench for handling wellbore tubulars, having upper and lower tong assemblies, each tong assembly comprising:

one or more die blocks for receiving a die to grip a wellbore tubular, each die block forming at least two opposed slot extensions for receiving the die therebetween, each die block defining a retainer-pin bore positioned at each end of the at least two opposed slot extensions, and a retainer pin for positioning within each retainer-pin bore and configured for releasably securing the die between the at least two opposed slot extensions, wherein each die block defines at least a pair of dowel bores, wherein each dowel bore is configured for receiving a dowel therein for securing each retainer pin within its respective retainer-pin bore, wherein each retainer pin comprises a biasing mechanism to allow the retainer pin to move between an extended position and a compressed position within a respective retainer-pin bore, and wherein the die is releasable from between the least two opposed slot extensions when the retainer pin is in the compressed position.

2. The tong assemblies of claim 1, wherein the biasing mechanism of each retainer pin is a coil spring that is positioned about a shaft section of each retainer pin.

3. The tong assemblies of claim 2, wherein the coil spring is configured for exerting an outward force on the retainer pin.

4. The tong assemblies of claim 1, wherein each retainer pin forms a shoulder at one end for abutting the die, for securing the die between each end of the at least two opposed slot extensions.

5. The tong assemblies of claim 1, wherein together the at least two opposed slot extensions secure the die along its sides and each retainer pin secures the die at an end.

6. The tong assemblies of claim 1, wherein each retainer-pin bore comprises at least two sections having different internal diameters from one another.

7. The tong assemblies of claim 6, wherein each retainer-pin bore comprises at least three sections having different internal diameters from one another.

8. The tong assemblies of claim 6, wherein the biasing mechanism of each retainer pin is a coil spring that is positioned about a shaft section of each retainer pin, and wherein a first section of the at least two sections of each retainer-pin bore has a first internal diameter that is configured to receive the shaft section of the retainer pin with the coil spring positioned thereabout.

9. The tong assemblies of claim 8, wherein a second section of the at least two sections of each retainer-pin bore has a second internal diameter that is smaller than the first internal diameter of the first section and configured to receive the shaft section of the retainer pin.

10. The tong assemblies of claim 9, wherein each retainer-pin bore comprises a third section that has a third internal diameter that is smaller than the second internal diameter of the second section, and wherein the third section is configured to prevent suctioning of each retainer pin within each retainer-pin bore.

11. The tong assemblies of claim 1, wherein each retainer pin forms a dowel slot for receiving one of the dowels therein, and wherein each dowel slot is configured to allow movement of the retainer pin between the compressed position and the extended position while the dowel is received within the dowel slot.

12. The tong assemblies of claim 1, wherein each die block further defines a ventilation hole that is configured to prevent suctioning of each retainer pin within each retainer-pin bore.

13. An automated drilling rig floor wrench for handling wellbore tubulars, having upper and lower tong assemblies, each tong assembly comprising:

one or more die blocks for receiving a die to grip a wellbore tubular, each die block forming at least two opposed slot extensions for receiving the die therebetween, each die block defining a retainer-pin bore positioned at each end of the at least two opposed slot extensions, wherein each retainer-pin bore comprises at least two sections having different internal diameters from one another, and a retainer pin for positioning within each retainer-pin bore and configured for releasably securing the die between the at least two opposed slot extensions, wherein each retainer pin comprises a coil spring to allow the retainer pin to move between an extended position and a compressed position within a respective retainer-pin bore, the coil spring being positioned about a shaft section of each retainer pin, wherein a first section of the at least two sections of each retainer-pin bore has a first internal diameter that is configured to receive the shaft section of the retainer pin with the coil spring positioned thereabout, wherein a second section of the at least two sections of each retainer-pin bore has a second internal diameter that is smaller than the first internal diameter of the first section and configured to receive the shaft section of the retainer pin, wherein a third section of the at least two sections of each retainer-pin bore has a third internal diameter that is smaller than the second internal diameter of the second section, wherein the third section is configured to prevent suctioning of each retainer pin within each retainer-pin bore, wherein each die block defines at least a pair of dowel bores, wherein each dowel bore is configured for a dowel therein for securing each retainer pin within its respective retainer-pin bore, and wherein the die is releasable from between the least two opposed slot extensions when the retainer pin is in the compressed position.

14. The tong assemblies of claim 13, wherein each retainer pin forms a shoulder at one end for abutting the die, for securing the die between each end of the at least two opposed slot extensions.

15. The tong assemblies of claim 13, wherein together the at least two opposed slot extensions secure the die along its sides and each retainer pin secures the die at an end.

16. The tong assemblies of claim 13, wherein the coil spring is configured for exerting an outward force on the retainer pin.

17. The tong assemblies of claim 13, wherein each retainer pin forms a dowel slot for receiving one of the dowels therein, and wherein each dowel slot is configured to allow movement of the retainer pin between the compressed position and the extended position while the dowel is received within the dowel slot.

* * * * *